US007559515B2

(12) United States Patent
Naporano

(10) Patent No.: US 7,559,515 B2
(45) Date of Patent: Jul. 14, 2009

(54) SNAP SAFE

(76) Inventor: Sarah Naporano, 1385 Oak Haven Dr., Roswell, GA (US) 30075

( * ) Notice: Subject to any disclaimer, the term of this patent is extended or adjusted under 35 U.S.C. 154(b) by 0 days.

(21) Appl. No.: 11/999,107

(22) Filed: Dec. 4, 2007

(65) Prior Publication Data

US 2008/0135693 A1 Jun. 12, 2008

Related U.S. Application Data

(60) Provisional application No. 60/868,612, filed on Dec. 5, 2006.

(51) Int. Cl.
*A47G 23/02* (2006.01)

(52) U.S. Cl. ..... 248/146; 248/206.3; 248/346.06

(58) Field of Classification Search ..... 248/121, 248/251, 205.5, 205.6, 205.8, 206.2, 206.3, 248/346.01, 346.03, 346.06, 346.3, 346.5, 248/146, 154

See application file for complete search history.

(56) References Cited

U.S. PATENT DOCUMENTS 2,009,721 A * 7/1935 Williams ..... 224/309
2,123,549 A * 7/1938 Williams ..... 248/363
4,038,914 A * 8/1977 Crespo et al. ..... 99/279
4,363,402 A * 12/1982 Grzyll ..... 206/380
4,473,225 A * 9/1984 Miller ..... 482/40
4,884,714 A * 12/1989 Bechtel ..... 220/630
5,599,063 A * 2/1997 Lister et al. ..... 297/325
5,687,433 A * 11/1997 Garner et al. ..... 4/572.1
5,940,900 A * 8/1999 Wells ..... 4/515
6,264,259 B1 * 7/2001 Fortune ..... 294/64.1
6,619,734 B2 9/2003 Helmsderfer
2005/0136793 A1 * 6/2005 Strunk ..... 446/487

FOREIGN PATENT DOCUMENTS

GB 2069461 A * 8/1981

* cited by examiner

*Primary Examiner*—Korie H. Chan
(74) *Attorney, Agent, or Firm*—James Ray & Assoc.

(57) ABSTRACT

An apparatus for securing an infant carrier to a flat surface so that such carrier is not in danger of falling off or being pulled down by curious toddler siblings. The apparatus comprises a base member having a predetermined shape and size and is formed of a predetermined material. The base member has a bottom portion and a sidewall portion. There is at least one bar member that is engageable with the sidewall portion of the base member and is further engageable with such infant carrier for securing such infant carrier to the bar member. A bracket, for removably securing the bar member to such sidewall portion, is engageable with the sidewall portion and with at least one bar member. A plurality of suction cups are disposed at predetermined positions on an underside surface of the bottom portion of the base member for securing the apparatus to such flat surface.

18 Claims, 3 Drawing Sheets

SNAP SAFE

CROSS REFERENCE TO RELATED APPLICATIONS

This application is closely related to and claims benefit from U.S. Provisional Application Ser. No. 60/868,612 filed Dec. 5, 2006.

FIELD OF THE INVENTION

The present invention relates, in general, to a infant carrier, and, more particularly, the present invention relates to a means for securing such infant carrier to flat surface so that such carrier cannot be tipped over or pulled down by such infant's siblings.

BACKGROUND OF THE INVENTION

Many parents find it necessary to place a baby carrier or seat on a flat surface such as a table in order to interact with the infant resting in the carrier. Even such movement as feeding the baby can result in movement of the carrier, as the uneven bottom surface can slide and move causing difficulty in changing or feeding the baby. Other, older children cannot resist the temptation of seeing the baby and are known to pull or move the carrier, which can have dangerous and awkward results. Great care is required in preventing any unwarranted movement of the carrier that might cause the carrier to be pulled off of the table that it is sitting on.

Thus, it would be advantageous if there were a means that could be used to secure such baby carrier or seat to the flat surface so as to safeguard the infant that is using the carrier.

SUMMARY OF THE INVENTION

In a first aspect the present invention provides an apparatus for securing an infant carrier to a flat surface so that such carrier is not in danger of falling off or being pulled down by curious toddler siblings. The apparatus comprises a base member having a predetermined shape, a predetermined size and formed of a predetermined material. The base member has a bottom portion and a sidewall portion. There is at least one bar member that is engageable with the sidewall portion of the base member and is further engageable with such infant carrier for securing such infant carrier to the bar member. A means for removably securing at least one bar member to such sidewall portion is engageable with the sidewall portion and with the at least one bar member. A plurality of suction cups are disposed at predetermined positions on an underside surface of the bottom portion of the base member for securing the apparatus to such flat surface.

OBJECTS OF THE INVENTION

It is, therefore, one of the primary objects of the present invention to provide a convenient device to secure an infant carrier to a flat surface.

Another object of the present invention is to provide an apparatus that will prevent such baby carrier from rocking, moving or being pulled or pushed.

Still another object of the present invention is to provide an apparatus that will secure such baby carrier to such flat surface so the baby can be fed in the carrier without the carrier moving.

Yet another object of the present invention is to provide an apparatus for securing a baby carrier that is secured to such flat surface by locking suction cups that are releasable with a push button.

Another object of the present invention is to provide an apparatus that is capable of being adjusted so as to change the angle at which the car seat can be positioned.

It is another object of the present invention to provide an apparatus into which the carrier locks in place for a secure hold.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
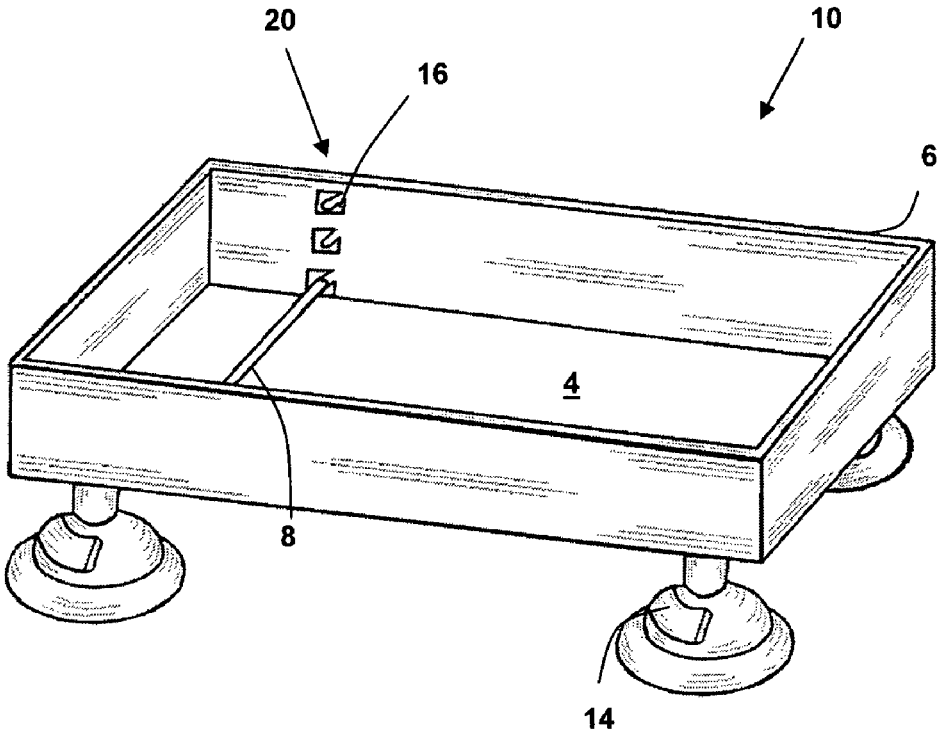
FIG. 1 is a side perspective view of the apparatus according to an embodiment of the invention.
Figure 2:
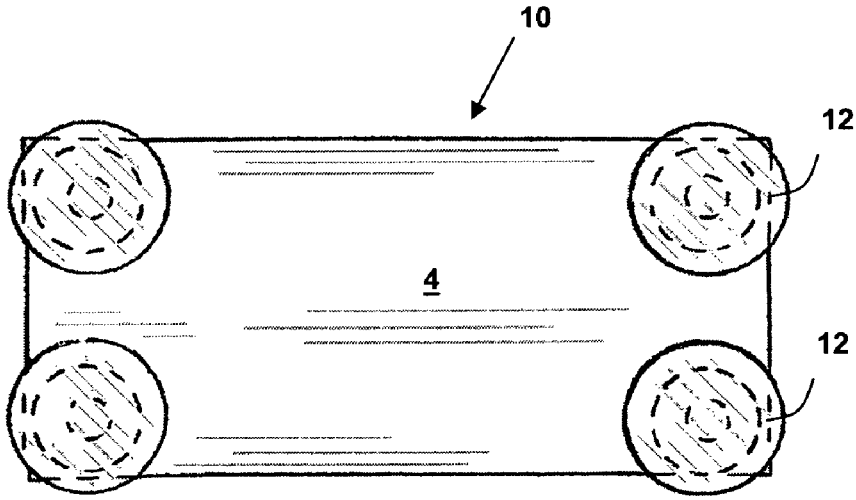
FIG. 2 is a bottom view of the apparatus shown in FIG. 1 showing the suction cups.
Figure 3:
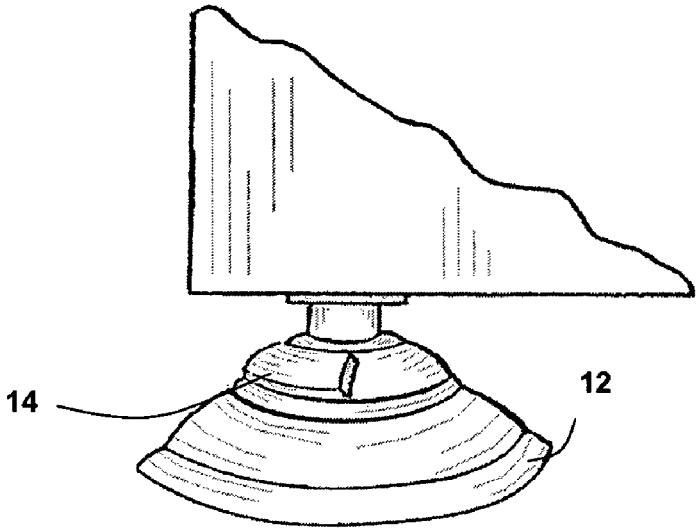
FIG. 3 is a perspective view of a portion of the apparatus shown in FIG. 1 showing the pushbutton release for the suction cups.
Figure 4:
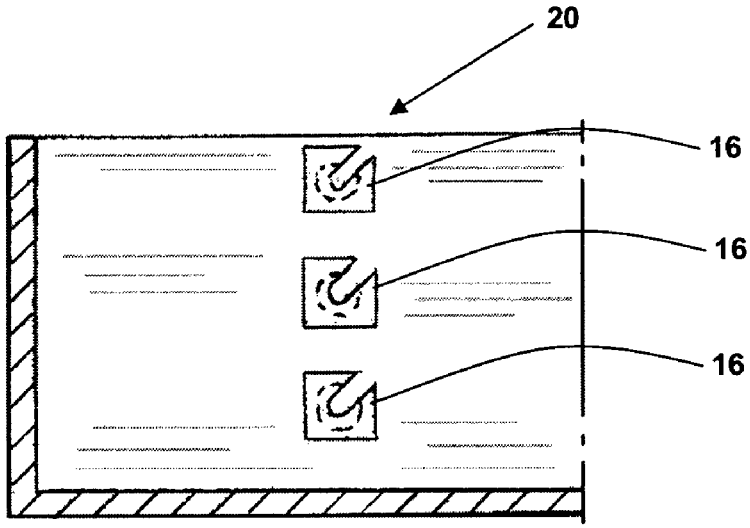
FIG. 4 is a top perspective view of a portion of the apparatus shown in FIG. 1 showing different bracket positions for attachment of such bar member for providing different incline levels for positioning the carrier.
Figure 6:
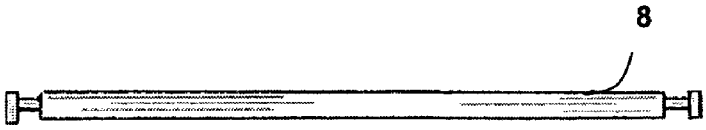
FIG. 6 is a view of the bar member showing how it can fit into the bracket member.
Figure 5:
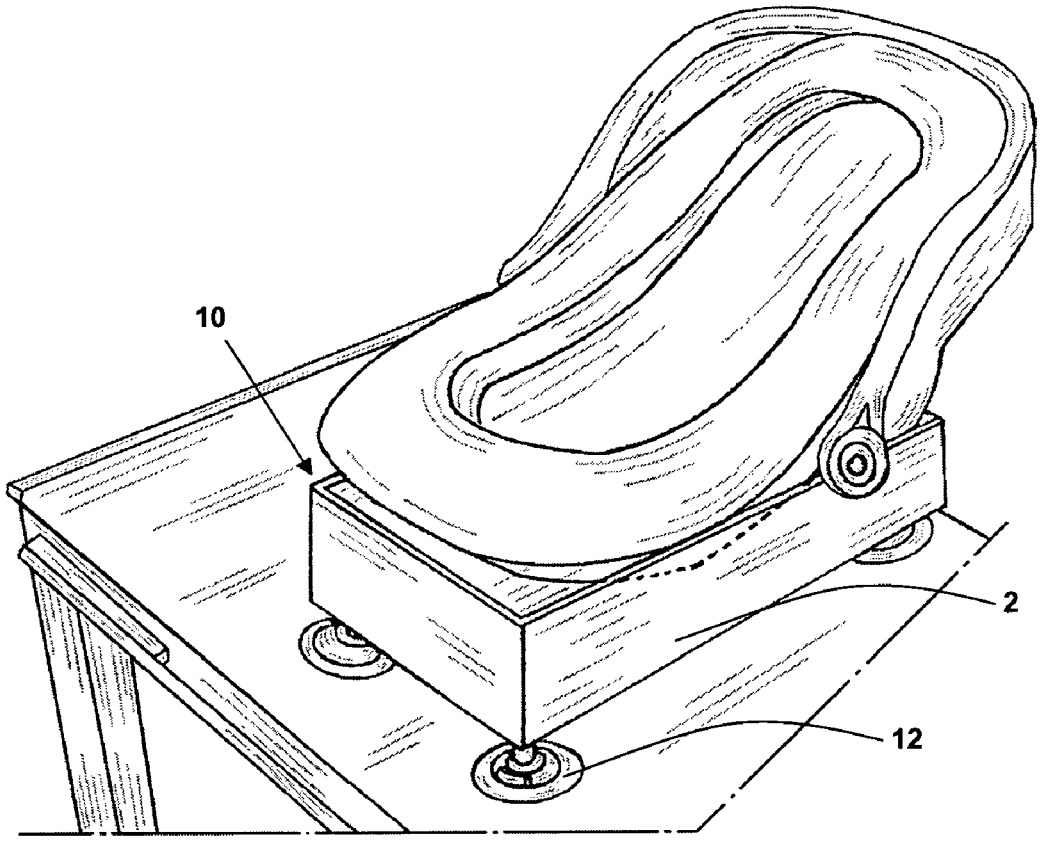
FIG. 5 is a side perspective view of the apparatus shown in FIG. 1 with a baby carrier positioned on the apparatus.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for securing an infant carrier to a flat surface so that such carrier is not in danger of falling off or being pulled down by curious toddler siblings. The apparatus 10 comprises a base member 2 having a predetermined shape, a predetermined size and formed a of a predetermined material. The base member 2 has a bottom portion 4 and a sidewall portion 6. Such sidewall portion 6 extending upwardly from such bottom portion. The sidewall portion 6 encloses the bottom portion 4 of the base member 2 as is clearly seen in FIG. 1. There is at least one bar member 8 that is engageable with the sidewall portion 6 of the base member 2, and is further engageable with such infant carrier for securing such infant carrier to the bar member 2. A means, generally designated 20, for removably securing the at least one bar member 8 to the sidewall portion is engageable with the sidewall portion 6 and with the at least one bar member 8. A plurality of suction cups 12 are disposed at predetermined positions on an underside surface of the bottom portion 4 of the base member 2 for securing the apparatus 10 to such flat surface.

The predetermined shape of the base member 2 is selected from one of circular, oval, square and rectangular or even other shapes; however, it is presently preferred that such shape is generally rectangular. This is preferred shape since most, if not all, baby carriers tend to be generally rectangular. It is also preferred that such predetermined material for forming such base member 2 is plastic.

The plurality of suction cups 12 is at least three. For some of the possible shapes, such as circular or oval, all that is needed to provide a secure attachment to the flat surface is three suction cups 12 that are positioned appropriately. However, since the preferred shape is rectangular it is also preferred that there are four suction cups 12 wherein each suction cup 12 is disposed at each corner on an underside of the bottom portion 4 of the base member 2. It is also preferred that such apparatus 10 further include a means for releasing the plurality of suction cups and that such means includes a push button release 14. Such predetermined material is selected from plastic, wood or metal.

It should be noted that such carrier locks onto the bar member 8 so as to secure such carrier in place.

In the presently preferred embodiment such apparatus 10 includes two sidewalls 6 and two endwalls 6 on the generally rectangular apparatus 10.

The means 20 for removably securing the at least one bar member to the sidewall portion includes at least one pair of brackets 16, each of the pair of brackets 16 is disposed on a radially opposed sidewall 6. Such means 20 can also include three pairs of brackets 16, each pair of brackets 16 being disposed at a different elevation. By having the different brackets 16 at different heights the bar member 8 can be placed in whichever set of brackets 16 the user desires whether it is a set in which the carrier may be positioned for feeding or for reclining.

Each pair of the three pairs of brackets 16 are disposed on radially opposed sidewalls 6 and are disposed in a vertical arrangement in which one bracket 12 of each pair is disposed above another bracket 12 of another pair and wherein each bracket 12 is a predetermined distance from another bracket 12 thereby providing three different elevations at which the infant carrier may be positioned so that such infant carrier can be positioned in the brackets 16 that provide the best position for whatever the parent wishes whether it is for feeding the infant of for letting the infant sleep or for just sitting.

The one bar member 8 is removably engageable with the brackets 16 for removably securing the bar member 8 to the sidewall portion 6. The bracket 16 has a U-shaped opening disposed in a center portion of the bracket 16 so that the bar member 8 can slide in and out of the bracket 16 when on desires to change the position of the infant carrier.

Thus the present invention provides an apparatus that has a base for acceptance of a baby carrier or seat that will hold the attached carrier in place during interaction with the infant. The suction-cupped base member will easily hold on any flat surface on which it is placed which allows the parent to keep the infant in one position for activity and feeding, for example. The rectangular shaped base member of the apparatus is designed to easily accept any baby carrier which will snap to interlock into place. There is a bar that is attached to the base member onto which the baby carrier locks for a secure hold. The apparatus features the capability of being set in one of three adjustable positions as desired. The suction cups provide ease in attaching to any flat surface and will remain in place until removed with a push button release. The apparatus can remain attached to the carrier for placement as needed. Removing the base is simple and the portable portion can be taken along for use anywhere.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for securing an infant carrier to a flat surface so that such infant carrier is not in danger of falling off or being pulled down by curious toddler siblings, said apparatus comprising:

(a) a base member having a predetermined shape, a predetermined size and formed a of a predetermined material, said base member having a bottom portion and a sidewall portion extending upwardly from said bottom portion, said sidewall portion enclosing an entire perimeter of said bottom portion of said base member;

(b) at least one bar member engageable with said sidewall portion of said base member and further engageable with such infant carrier for securing such infant carrier to said at least one bar member, such infant carrier resting on an upper surface of said bottom portion of said base member when secured to said at least one bar member;

(c) a means engageable with said sidewall portion and said at least one bar member for removably securing said at least one bar member to said sidewall portion; and (d) a plurality of suction cups disposed at predetermined positions on an underside surface of said bottom portion of said base member for securing said apparatus to such flat surface.

2. The apparatus, according to claim 1, wherein said predetermined shape of said base member is selected from one of circular, oval, square and rectangular.

3. The apparatus, according to claim 2, wherein said predetermined shape is generally rectangular.

4. The apparatus, according to claim 2, wherein said plurality of suction cups is at least three.

5. The apparatus, according to claim 3, wherein said plurality of suction cups is four.

6. The apparatus, according to claim 5, wherein said suction cups are disposed at each corner on an underside of said bottom portion of said base member.

7. The apparatus, according to claim 1, wherein said apparatus further includes a means for releasing said plurality of suction cups.

8. The apparatus, according to claim 7, wherein said means for releasing said plurality of suction cups includes a push button release.

9. The apparatus, according to claim 1, wherein such infant carrier locks onto said bar member so as to secure such infant carrier in place.

10. The apparatus, according to claim 3, wherein said sidewall portion of said apparatus includes two sidewalls and two endwalls on said generally rectangular apparatus.

11. The apparatus, according to claim 1, wherein said means for removably securing said at least one bar member to said sidewall portion includes at least one pair of brackets, each of said at least one pair of brackets disposed on a radially opposed sidewall.

12. The apparatus, according to claim 11, wherein said means includes three pairs of brackets, each pair of brackets being disposed at a different elevation.

13. The apparatus, according to claim 12, wherein each pair of said three pairs of brackets are disposed on radially opposed sidewalls.

14. The apparatus, according to claim 13, wherein said each pair of said three pairs of brackets are disposed in a vertical arrangement one bracket of each pair disposed above another bracket of another pair and wherein each bracket is a predetermined distance from said another bracket.

15. The apparatus, according to claim 14, wherein said three pairs of brackets provides three different positions for such infant carrier so as to position such infant carrier for one of feeding, sleeping and sitting.

16. The apparatus, according to claim 1, wherein said at least one bar member is removably engageable with said means for removably securing said at least one bar member to said sidewall portion.

17. The apparatus, according to claim 11, wherein said at least one pair of brackets has a U-shaped opening disposed in a center portion of said at least one pair of brackets for engagement with said at least one bar member.

18. The apparatus, according to claim 1, wherein said predetermined material for forming said base member is plastic.

* * * * *